United States Patent [19]

Moss et al.

[11] 4,154,036

[45] May 15, 1979

[54] BUILDING STRUCTURES

[75] Inventors: Graham Moss, Knoxfield; Frederick W. Millar, Frankston, both of Australia

[73] Assignee: Gibbs Bright & Co. Pty. Ltd., Victoria, Australia

[21] Appl. No.: 819,766

[22] Filed: Aug. 1, 1977

[30] Foreign Application Priority Data

Aug. 2, 1976 [AU] Australia ..... PC6853

[51] Int. Cl.[2] ..... E04B 1/10

[52] U.S. Cl. ..... 52/282; 52/233; 52/403

[58] Field of Search ..... 52/233, 281, 282, 284, 52/261, 262, 496, 403, 778, 779; 256/24, 27, 69, 65, DIG. 5

[56] References Cited

U.S. PATENT DOCUMENTS

| | | | |
|---|---|---|---|
| 1,322,203 | 11/1919 | Schroeder | 403/403 |
| 2,160,225 | 5/1939 | Newman | 52/281 |
| 3,280,525 | 10/1966 | Crowley | 52/396 |
| 3,691,708 | 9/1972 | Firnkas | 52/403 |
| 4,051,641 | 10/1977 | Elliott | 52/282 |

FOREIGN PATENT DOCUMENTS

| | | | |
|---|---|---|---|
| 2309878 | 8/1974 | Fed. Rep. of Germany | 52/233 |
| 243145 | 11/1925 | United Kingdom | 52/778 |

*Primary Examiner*—John E. Murtagh

[57] ABSTRACT

Wall of timber logs is built by fastening log ends to vertical steel studs. Log ends are notched at inner side of wall to present flat notch faces to flanges of studs. Stud flanges are pre-drilled with vertically spaced holes and fasteners are extended through selected holes into log ends. Weather seals are formed between the logs and extruded plastic strip for this purpose is also disclosed.

7 Claims, 14 Drawing Figures

FIG. 1.
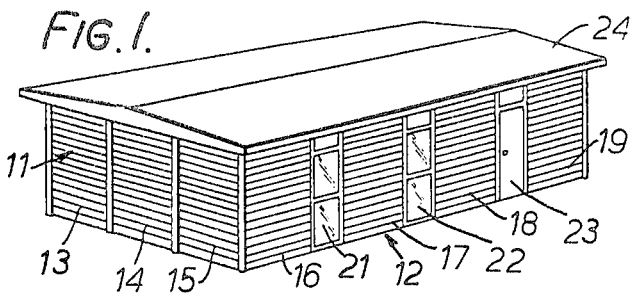
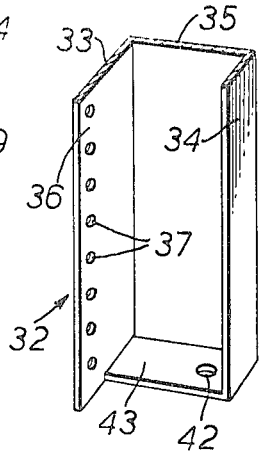
FIG. 5.
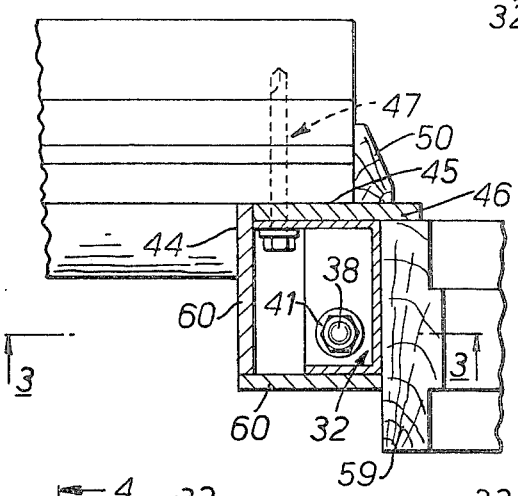
FIG. 2.
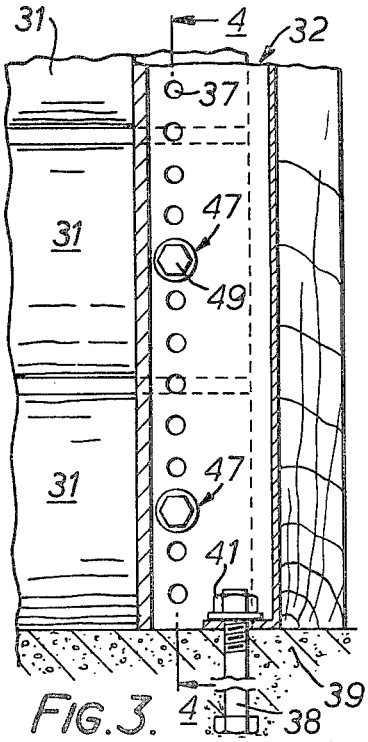
FIG. 3.
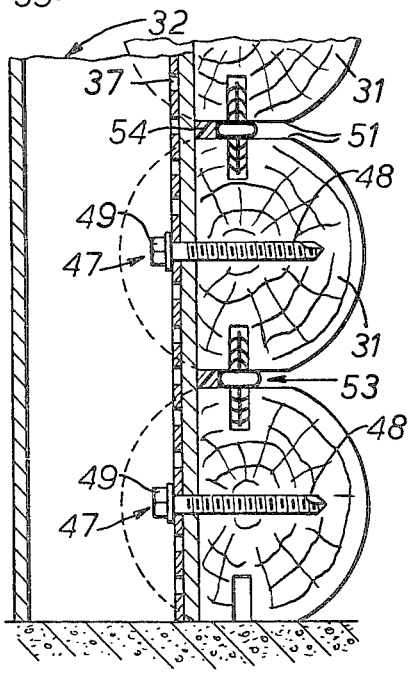
FIG. 4.

BUILDING STRUCTURES

BACKGROUND OF THE INVENTION

This invention relates to building structures and it is particularly, but not exclusively, applicable to log cabin structures.

Australian Pat. No. 425,916 discloses a log cabin structure which comprises a vertical series of superimposed logs cut to the same length and of similar timber. Slots in the ends of the logs are positioned in vertical alignment to receive flanges of a vertical stud member which keeps the logs aligned and in position. The vertical stud member is constituted by a metal section which may, for example, be a channel section, an angle section or two connected angle sections as further disclosed in the Australian patent. Strips of waterproof plastic material are positioned between the logs so as to be compressed by the weight of the logs to provide effective weather sealing.

The log cabin structure described in Australian Pat. No. 425,916 enables the cabin components to be prefabricated in a factory and erected very rapidly on site. The structure has proved most successful and is completely satisfactory in most situations. However, one problem which can arise, depending upon the properties of the available timber logs and the climatic conditions, is that shrinkage of the logs can lead to a loss of effectiveness of some of the water seals provided by the compressed waterproof plastic strips. As the logs shrink they tend to settle downwardly and the settling movement accumulates up each set of logs so that toward the upper end of the set the settling movements can become quite appreciable and can cause a loss of compression in the resilient sealing strips in the upper parts of the wall of the cabin walls. U.S. Pat. No. 3,979,862 describes certain modifications to the basic structure disclosed by Australian Pat. No. 425,916 and in particular describes how the accumulation of shrinkage movements up the log sets can be avoided by the use of timber wedges driven into the slots in the logs and against the studs. The present invention provides a further improved construction by which the advantages of prefabrication and rapid erection techniques can be maintained but in which the ends of the elongate members (such as the logs in a cabin structure) can be even more firmly secured to the studs to ensure absolute stability of the structure and improved weather sealing. The construction according to the invention also provides an arrangement in which the metal studs can be effectively shielded from exposure to the weather.

The invention further provides an improved type of weather sealing strip and extends to building structures, for example log cabins, incorporating such improved weather strips.

BRIEF SUMMARY OF THE INVENTION

According to the invention there is provided a buildng structure comprising a wall section having an outer face and an inner face, said wall section comprising a set of superimposed substantially horizontal elongate members each having at one end of the wall section a notch which presents a flat notch face facing inwardly of the wall section and set back from the inner face of the wall section, the flat faces of the notches being vertically aligned with one another, an elongate vertical stud member having a flange extending vertically alongside the aligned flat notch faces of the superimposed elongate members, a plurality of vertically spaced holes in said flange and a plurality of fasteners extended through at least some of said holes and securing the notched ends of said elongate members to said flange.

Preferably each fastener comprises a screw member having a threaded stem screwed into the respective elongate member and a head portion overlying said flange.

Preferably too, said holes are arranged along the flange at a spacing which is less than the average vertical height of the individual elongate members and the fasteners extend only through some of those holes and at least one into each elongate member.

Said building structure may include a further wall section comprised of a further set of superimposed substantially horizontal elongate members and the stud member may form part of a connection between the first said wall section and the further wall section. In that case the horizontal elongate members of the further wall section may each have at one end of that further wall section a notch which presents a flat face facing inwardly of the further wall section and set back from the inner face of that wall section and the stud member may have an additional flange extending vertically alongside the aligned flat faces of the notches in the further set of horizontal elongate members and having a plurality of vertically spaced holes and there may be a further plurality of fasteners extending through at least some of the holes in the additional flange and securing the notched ends of the further set of superimposed horizontal elongate members to said additional flange. The two wall sections may be adjacent sections of a single wall in which case the two flanges of the stud member may be horizontally opposed to one another and an elongate upright timber cover member may be disposed across the gap between the notched ends of the two elongate members at the outer face of the wall.

The substantially elongate members may have flat upper and lower faces defining interfaces between the elongate members of the set and each interface between a successive pair of elongate members may be sealed by sealing means comprising an elongate sealing strip projecting into a pair of vertically aligned slots, formed one in each of the faces defining the interface.

The invention also extends to a building structure having a wall section comprising a set of superimposed substantially horizontal elongate members between which there are disposed weather sealing strips extending along the interfaces between the elongate members and projecting upwardly and downwardly into longitudinal slots formed in the elongate members, each sealing strip comprising a pair of web portions extending into the respective pair of slots and each carrying side flange portions which project outwardly and backwardly toward the central portion of the strip.

Preferably, the side flange portions on each web portion of the sealing strips are arranged in pairs spaced laterally of the strip with the side flange portions of each pair disposed one to either side of the web portion in V-formation so that they diverge from their connections to the web portion outwardly and backwardly toward the central portion of the strip.

In order that the invention may be more fully explained one particular embodiment will be described in detail with reference to the accompanying drawings.

BRIEF DESCRIPTION OF THE DRAWINGS

FIG. 1 is a perspective view of a log cabin constructed in accordance with the invention;

FIG. 2 is a horizontal cross-section through part of a wall of the cabin showing the manner in which log ends and a window or door frame are connected to a metal stud member;

FIG. 3 is a cross-section on the line 3—3 in FIG. 2;

FIG. 4 is a cross-section on the line 4—4 in FIG. 3;

FIG. 5 is a scrap perspective view of the bottom end of one of the stud members of the building structure;

DESCRIPTION OF PREFERRED EMBODIMENT

Figure 6:
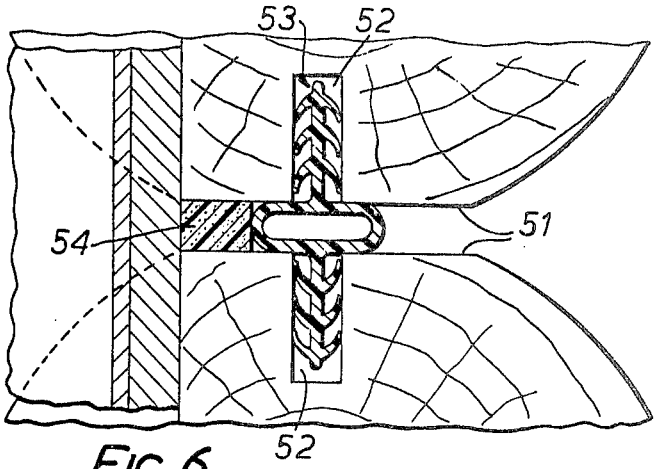
FIG. 6 is an enlargement of part of the cross-section of FIG. 4 showing the manner in which a weather seal is formed between adjacent logs by means of an extruded sealing strip of pliable plastic and a compressible foam plastic strip.

The illustrated log cabin has end walls 11 and side walls 12 each comprised of a number of adjoining wall sections comprised of vertical series of superimposed logs cut to the same length and of similar diameter. Specifically the end wall 11 seen in FIG. 1 is comprised of three adjoining wall sections 13, 14, 15 and the side wall 12 visible in the same Figure is formed by wall sections 16, 17, 18, 19 which are separated by windows 21, 22 and a door 23 installed in the side wall. The structure also has a roof 24 which my be of conventional construction and plays no part in the present invention.

Figure 12:
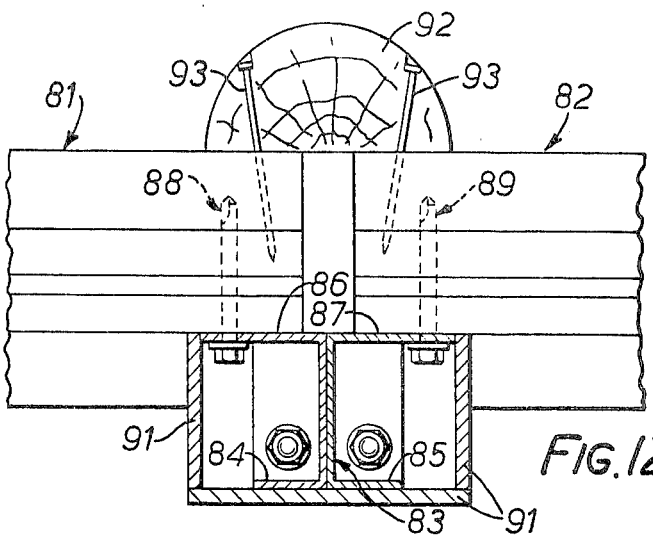
FIG. 12 is a horizontal cross-section showing the connection of two adjacent wall sections to a single stud.
Figure 13:
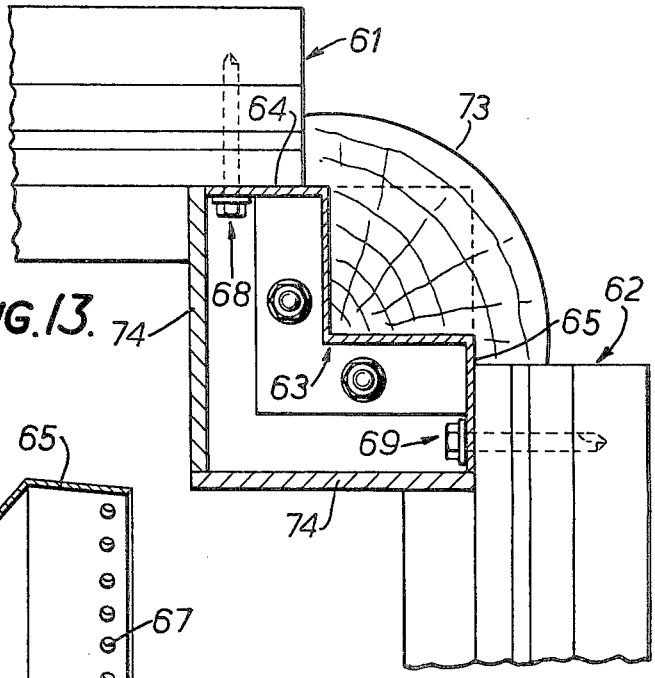
FIG. 13 is a horizontal cross-section showing the connection between a stud and two wall sections at a corner of the cabin.
Figure 14:
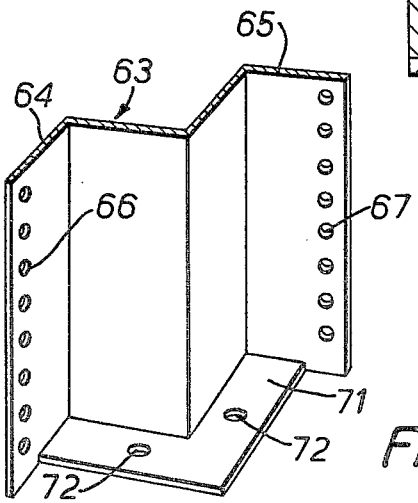
FIG. 14 is a scrap perspective view of the bottom end of the corner stud seen in FIG. 13.

FIGS. 2 to 5 illustrated the manner in which the ends of wall section 16, 17, 18, 19, adjacent the windows 21, 22, and door 23, are connected to vertical studs; FIG. 12 illustrates the manner in which the end wall sections 13, 14, 15 are connected together; and FIGS. 13 and 14 illustrate the connection between mutually perpendicular wall sections at the four corners of the cabin.

FIGS. 2 to 5 illustrate the connection between a set of superimposed horizontal logs 31 and a vertiçal steel stud 32. Stud 32 is formed as a channel section having flanges 33, 34 and a connecting web 35 with flange 33 being wider than flange 34 so as to have an edge margin 36 which projects beyond the outer edge of flange 34 in the direction away from web 35. This margin 36 of flange 33 is perforated by a series of vertically spaced holes 37.

Stud 32 is firmly bolted into position by means of an anchor bolt 38 which extends upwardly through a hole 42 in a foot plate 43 welded to the lower end of stud 32. Bolt 38 is fitted with a clamping unit 41 to enable the foot of the stud to be firmly clamped to the cabin floor. FIG. 3 shows bolt 38 set into a concrete floor 39 of the cabin but in the case of a cabin with timer flooring the anchor bolt may be passed through a hole drilled in the floor frame. The stud is anchored so that its wider flange 33 extends in the direction of the wall and is located outwardly from flange 34.

Logs 31 have end notches 44 with notched faces 45 set back from the inner face 46 of the wall and facing inwardly of the wall. Notch faces 45 are vertically aligned and the flange 33 of stud 32 extends vertically alongside them. A vertical timber flashing strip 46 is inserted between the aligned flat notch faces 45 and stud flange 33 and the notched log ends are firmly secured to stud flange 33 by means of a plurality of fasteners denoted generally as 47. Each fastener comprises a screw member 48 which is extended through one of the holes 37 in stud flange 33 and through timber flashing strip 46 into one of the log ends. Screw members 48 may have self-tapping screw end so that on erection of the cabin they can be run rapidly through timber flashing strip 46 and into the log ends. They have enlarged head portions 49 which overlie the inner face of stud flange 33 so that on tightening of the screw members the log ends are firmly clamped to the stud flange with the timber flashing strip 46 being sandwiched between the log ends and the stud flange. Screw members 48 may be fitted with washers between the stud flange 33 and the screw heads 49.

Figure 7:
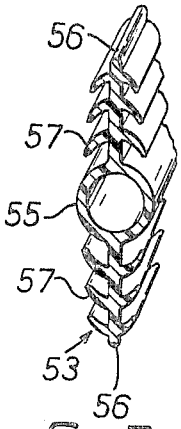
FIG. 7 is a scrap perspective view of the pliable plastic strip seen in FIGS. 4 and 6.

FIGS. 4, 6 and 7 illustrate the manner in which water seals are formed between successive logs 31. The diametrically opposite upper and lower sides of the logs are machined to produce narrow flat log faces 51 which form an interface between successive logs and deep rectangular slots 52 are machined into the logs so as to extend along faces 51. An extruded plastic sealing strip 53 extends along the interface with its upper and lower margins projecting into the upper and lower log slots at the interface. In addition a horizontal strip 54 of resilient waterproof material extends along the interface so as to be sandwiched between log face 51 immediately to the inner side of sealing strip 53.

Sealing strip 53 is extruded so as to have a central tubular portion 55 from which a pair of web portions 56 project in mutually opposite directions. Web portions 56 carry side flange portions 57 which are arranged in pairs spaced laterally of the strip with the two side flanges of each pair disposed one to either side of the strip in V-formation so that they diverge from their connections to the web portions outwardly and backwardly toward the central portion of the strip. The sealing strip is extruded from a pliable plastics material such as polyvinyl-chloride. When the strip is in an undeformed condition, as illustrated by FIG. 7, the central tubular portion 55 is of substantially circular cross-section and the V-formation of side flange portions 57 become successively narrower toward the outer edges of web portions 56. When the strip is fitted between a pair of logs its central portion is squashed to the wide oval shape as seen in FIG. 6. The side flanges 57 are a force fit with slots 52 so that they are caused to flex inwardly toward the central web portion 56 of the strip when the strip is fitted into the slots. The outer edges of the side flanges are thus held firmly in engagement with the walls of slots 52 to form successive water seals around the perimeter of the slot. Moreover, the side flanges 57 define successive channels around the perimeter of each slot 52, and along which water can flow to the ends of the slots whence it can drop to the ground. Thus, any water driven inwardly against weather strip 53 would need to pass through the successive seals formed at the outer edges of side flanges 57 and across the water escape channels defined between those flanges in order to reach the space between the logs at the interior side of the weather strip 53. The central tubular portion 55 of sealing strip 53 can deform flexibly to accommodate any individual shrinkage movements of the logs. The flanged webs become firmly anchored in slots 52 but the central tubular portion can flex through a range of shapes from a shallow, wide oval shape through a truly cylindrical shape to a tall narrow oval shape to allow the variation of the distance between the thus anchored flanged webs.

Sealing strip 54 is provided to form a further barrier to cover the remote possibility that some water is able to transverse this path. Strip 54 may be formed of foamed plastic impregnated with waterproofing material such as bitumen, butyl or acrylic. A suitable bitumen impregnated material is marketed under the name "COMPRIBAND".

To assemble the wall section shown in FIGS. 2 to 5 the notched logs 31 are laid one by one working upwardly from the bottom of the wall section. Sealing strips 53, 54 are inserted between successive logs and, as each log is laid, at least one screw fastener 47 is driven through a hole 37 in stud flange 33 and into the log to firmly secure the end of the log in position. Holes 37 are predrilled or punched in the factory at a spacing which is much less than the average vertical height of the individual logs, so that, no matter what position a log adopts when it rests on the respective sealing strip 54, at least one hole will be appropriately positioned to enable a screw fastener to be run into the end of the log. In some instances, several screw fasteners may be run through a number of holes 37 and into a single log end. Since the log ends are thus firmly and permanently secured to the stud flange, shrinkage movements cannot accumulate up the stack. Thus sealing strips 53 and 54 are only required to maintain a seal against the individual shrinkage movements of the logs with which they are engaged. These movements are easily accommodated by flexure of the central tubular portions 55 of strips 53 and, in view of the fixture of the log ends to the stud all of the compressible sealing strips 54 will remain in a compressed condition. Thus, effective weather sealing will be maintained even should there be considered log shrinkage.

Figure 8:
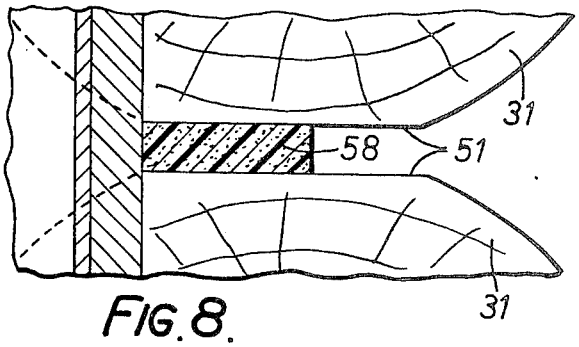
FIG. 8 is a vertical cross-strip corresponding to FIG. 6 but showing an alternative manner of forming the weather seal from a single compressible strip.
Figure 9:
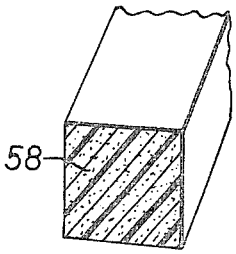
FIG. 9 is a scrap perspective view of the compressible sealing strip of FIG. 8 when in an uncompressed state.

Extruded sealing strips 53 are used in cabins which must withstand severe weather conditions. In some climates, however, it is possible to dispense with these strips and to form water seals with single strips of impregnated foam strips as illustrated in FIGS. 8 and 9. In this case the faces 51 of the logs are not slotted and simple rectangular strip 58 of the impregnated foam plastic is inserted between the flat, unslotted faces 51. Strip 58 is considerably larger than the strip 54 used in association with the extruded strip 53. When undeformed it may be generally square as shown in FIG. 6 but when sandwiched between the logs it is compressed and squashed to the wide rectangular cross-section seen in FIG. 8.

As mentioned above, the log/stud connection shown in FIGS. 2 to 5 can be used at the position where windows 21, 22 or door 23 is to be installed. As indicated in FIGS. 2 and 3 the window or door frame 59 may be fixed directly to the web 35 of stud 32 with its outer edge abutting the inner face of timber flashing strip 46. A timber mould strip 50 is fitted into the angle between the outer face of the flashing strip and the log end to trim the window or door frame and to cover the ends of the log slots 52. On the inside of the cabin the metal stud may be covered by a pair of timber cover strips 60.

Figure 10:
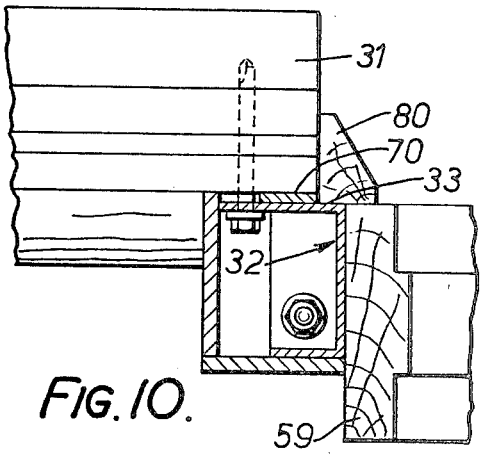
FIG. 10 is a horizontal cross-section corrsponding to FIG. 2 but showing a modification to the arrangement illustrated in the earlier Figure.
Figure 11:
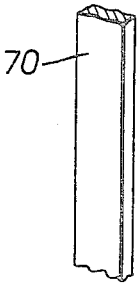
FIG. 11 is a scrap perspective view of a flashing strip used in the arrangement of FIG. 10.

An alternative manner of flashing frame 58 is shown in FIGS. 10 and 11. In place of a timber flashing strip, a thin rectangular strip 70 of impregnated foam plastic is sandwiched between stud flange 33 and log notch face 45 and a slightly larger mould strip 80 is fitted to engage stud flange 33 and frame 59.

FIG. 12 shows the manner in which end wall sections 13, 14, 15 may be connected together. In this case the two sets of logs 81, 82 lie side by side in the one wall and are connected to a single metal stud 83 at the connecton between them. Stud 83 is formed of two channel sections 84, 85, each similar to the channel stud 32 illustrated in the FIGS. 2 to 5. These channel sections 83, 84 are arranged back to back to form a single stud having mutually oppositely directed flanges 86, 87. These flanges are pre-drilled or punched in the same manner as the flange 33 of the first described joint and the ends of logs 81, 82 are secured to these flanges by screw fasteners 88, 89 in the manner previously described. A longitudinally sawn half log 92 is erected at the outer face of the wall to cover the gap between the ends of logs 81, 82. This half log may simply be skew nailed to logs 81, 82 by nails 93. At the inside of the cabin the stud is covered by a channel or base structure formed of three timber strips 91.

FIGS. 13 and 14 show the manner in which a corner joint is formed between mutually perpendicular log wall sections at a corner of the cabin. The logs 61 of one wall section and the logs 62 of the other wall section are engaged in the same manner as for the previously described joints and weather seals are fitted between them as before. However, in this case a relatively complex corner stud 63 is used. This may be prefabricated from two angle sections welded together toe to toe so as to have two flanges 64, 65 disposed in mutually perpendicular vertical planes and it may be provided with angle shaped foot plate 71 having anchor bolt holes 72. Flanges 64, 65 have pre-punched or pre-drilled vertically spaced holes 66, 67 and the notched ends of logs 61, 62 are fastened to these flanges by means of screw fasteners 68, 69 in the same manner as the ends of logs 31 were fastened to the stud flange 33 in the joint of FIGS. 2 to 5. A machined vertical log section 73 may be fitted to the corner and skew nailed to logs 61, 62 to form an exterior corner cover shielding the metal stud 63 from the weather and at the inside of the cabin the stud may be covered by timber cover strips 74.

It will be appreciated that the joints incorporated in the illustrated cabin, whilst still permitting factory prefabrication and rapid-on-site erection of the cabin components, enable the ends of the logs to be permanently and firmly fastened to the metal studs so obviating accumulation of shrinkage movements which could otherwise impair the weather seals between the logs. Moreover, the construction may incorporate a much improved type of weather seal than has hitherto been used in log cabins of the same general type. It will also be seen that in each of the illustrated log/stud joints the metal stud is completely shielded and protected from the weather by timber components comprising the ends of the notched logs, the timber flashing and mould strips and the respective timber outer cover members. This is of particular advantage in extremely corrosive and/or cold ambient conditions. Since the screw fasteners do not extend completely through the logs to the exterior of the cabin they cannot serve as heat conductors to the studs and the interior of the cabin.

The illustrated cabin construction has been advanced by way of example only and it could be varied considerably. For example, for service in extremely corrosive ambient conditions additional sealing and flashing strips could be incorporated. The shapes of the metal studs could also be changed without affecting the construction principles involved. Moreover, the invention is not limited in application to a log cabin and it could be applied equally as well to constructions in which the superimposed elongate wall elements are not logs, but in the form of bars or planks or even panel sections. It is accordingly to be understood that the invention is in no way limited to the details of the illustrated construction and that many modifications and variations will fall within the scope of the appended claims.

We claim:

1. In a building structure having a wall comprised of two adjacent wall sections extending one to each side of an elongate vertical stud member forming part of a connection between the two wall sections, the improvement comprising:

each of said wall sections comprising a set of superimposed substantially horizontal elongate members each having at the end of the wall section adjacent the stud member a notch which presents a flat notch face facing inwardly of the wall section and set back from the inner face of the wall section, the flat faces of the notches being vertically aligned with one another;

the stud member having horizontally opposed flanges extending vertically one alongside the aligned flat notch faces of each of the wall sections;

the flanges of the stud member each having a plurality of vertically spaced holes;

a plurality of fasteners extending through at least some of said holes in each flange and securing the notched ends of the elongate members of the two wall sections to said flanges; and an elongate upright timber cover member disposed across the gap between the notched ends of the elongate members of the two wall sections at the outer face of the wall.

2. In a building structure having adjacent wall sections interconnected at a wall corner via an elongate vertical stud member, the improvement comprising:

each of the wall sections comprising a set of superimposed substantially horizontal elongate members each having at the end of the wall section adjacent the stud members a notch which presents a flat notch face facing inwardly of the wall section and set back from the inner face of the wall section, the flat faces of the notches being vertically aligned with one another;

the vertical stud member having a pair of flanges extending vertically one alongside the aligned flat notch faces of each of the wall sections;

means defining a plurality of vertically spaced holes in each of the flanges of the stud member;

a plurality of fasteners extending through at least some of the holes in each of said flanges and securing the notched ends of the elongate members of the two wall sections to the flanges of the stud member; and an elongate upright timber cover member disposed between the notched ends of the two sets of elongate members at the outside of the wall corner.

3. A log cabin structure including a wall section having an outer face and an inner face, said wall section comprising:

a set of superimposed substantially horizontal timber logs of generally cylindrical shape each having at one end a notch opening to the inner face of the wall section and extending from the log end to present a flat notch face facing inwardly of the wall section and set back from the inner face of the wall section, the flat faces of the notches being vertically aligned with one another;

a vertical metal stud having a flange extending vertically alongside the aligned flat notch faces of the logs;

means defining a plurality of vertically spaced holes perforating said flange at predetermined distances spaced apart by less than the average vertical thickness of the individual logs; and a plurality of screw fasteners having head portions overlying said flange and threaded stems extending through at least some of said holes and outwardly toward and through the flat notch faces of the logs, the screw fasteners being secured at least one to each of the logs with their stems neatly fitting the respective holes in said flange to fasten the notched log ends firmly at fixed heights to the metal stud.

4. A log cabin structure as claimed in claim 3, wherein the threaded stems of the screw fasteners are screwed into the timber of the logs outwardly of said flat notch faces.

5. A building structure as claimed in claim 3, further comprising a flashing strip sandwiched between the flange of the metal stud and the vertically elongate flat faces of said notches.

6. A building structure as claimed in claim 5, wherein said flashing strip is a strip of timber.

7. A building structure as claimed in claim 5, wherein said flashing strip is a strip of compressible weatherproof material.

* * * * *